US006622742B1

(12) United States Patent
Hanna

(10) Patent No.: US 6,622,742 B1
(45) Date of Patent: Sep. 23, 2003

(54) AWNING CABLE MANUFACTURE IN ASSEMBLY AND COMBINATION WITH AN AWNING'S ROLLER TUBE

(76) Inventor: John E Hanna, 1010 Industrial Rd. #15, Boulder City, CA (US) 89005

( * ) Notice: Subject to any disclaimer, the term of this patent is extended or adjusted under 35 U.S.C. 154(b) by 12 days.

(21) Appl. No.: 09/945,287

(22) Filed: Aug. 30, 2001

Related U.S. Application Data

(60) Provisional application No. 60/229,617, filed on Aug. 31, 2000.

(51) Int. Cl.[7] ..... E04H 15/08
(52) U.S. Cl. ..... 135/88.12; 160/67
(58) Field of Search ..... 135/87, 88.01, 135/88.1, 88.12, 903, 904; 160/65, 67

(56) References Cited

U.S. PATENT DOCUMENTS 2,678,687 A * 5/1954 Armstrong ..... 160/72
2,771,088 A * 11/1956 Soldan ..... 135/87
3,263,735 A * 8/1966 Vecchiarelli et al. ..... 160/242
4,214,488 A * 7/1980 Conrad ..... 474/148
4,733,840 A * 3/1988 D'Amore ..... 70/58 X
5,171,056 A * 12/1992 Faludy et al. ..... 135/88.12 X
5,280,687 A * 1/1994 Boiteau ..... 160/67 X
5,411,445 A * 5/1995 Oda ..... 474/154

* cited by examiner

*Primary Examiner*—James O. Hansen
(74) *Attorney, Agent, or Firm*—Frank L. Zugelter

(57) ABSTRACT

A cable manufacture (15) formed of a steel cable (23) along the length of which a plurality of ball stops (35, 36, 37) are intermittently crimped, having a fixed loop (26) formed of itself at its one end (27) and a ball stop (37) crimped proximate to its other end (34). Any one of the ball stops (35, 36, 37) seats against the body formation of a slot (43) in a hallow roller tube (33) which forms a slot (43, 46) while loop (26) attaches to a support (61) on side panel (19) of a home (20) which forms a slot (43, 46) such as a motor home in operation of the invention. The extent of the tube's awning (32) as it unravels with roller tube (33) from a closed mode is controlled by which ball stop (35, 36, 37) seats against the body formation. Cable manufacture (15) is installed to roller tube (33) either by slipping a ball stop behind the slot (43, 46) through a cap (40) at the end of roller tube or by drilling hole (48) of a larger diameter than the width of slot (43, 46) for introduction of a ball stop into the hollowness of roller tube (33), then sliding the ball stop to the central region of roller tube (33), placing cable manufacture (15) in line with support (61) for operation of the invention.

4 Claims, 3 Drawing Sheets

AWNING CABLE MANUFACTURE IN ASSEMBLY AND COMBINATION WITH AN AWNING'S ROLLER TUBE

This invention is related to the disclosure in U.S. Provisional application, Ser. No. 60/229,617, filed Aug. 31, 2000.

TECHNICAL FIELD

This invention pertains to a cable manufacture and particularly to a cable assembly and its cooperation and combination with an awning's roller tube.

BACKGROUND TO THE INVENTION

The prior art discloses fabric straps which pull down awnings along with their customary spring-biased actuated roller tube assemblies mounted to support arms pivotally mounted to window frames on a side of a vehicle such as a mobile home or RV vehicle. The fabric straps break, deteriorate, and rot over a period of time, say, in sun and rain belts of the country than otherwise. Also, these straps include staying elements by which straps and tube remain assembled together for operation. These staying elements require an additional separable element, a stem projecting to each side of a stitched end loop across the width of each strap by which it stays assembled to its roller tube via installation behind slots in the roller tubes. This invention obviates these disadvantages associated with conventional present-day mobile and recreational vehicles [RV's] awning straps currently in use. In addition, repetitious labor in and costs of replacing worn-out fabric straps that have become non-functional continue to increase as the spiral of inflation continues its merry way. This invention removes these detrimental incidents of labor, costs, and maintenance by the long-lasting life of the materials of the manufactures of this invention and the ease by which they are readily installed to and combined with roller tubes in their assembly to their awning apparata.

SUMMARY OF THE INVENTION

The invention is found in a cable manufacture fabricated from a flexible stainless metal cable, having a self-incorporated loop formed at its one end for connection to a support or clete on a side panel of a vehicle for maintaining an open mode for its window awning. One or more stops or staying elements, of hard material, such as metal, of sufficient size are secured intermittently along the cable's finite length and in proximity to the other or free end of the cable's length for retention or seating on the interior wall of a hollow roller tube at a body formation for a slot (of a lesser width than the size of the stops) in the roller tube to which the cable manufacture is assembled. The self-incorporated loop is formed by folding or turning back upon itself the cable to thereby abut a point along its length adjacent its one end and crimping together these abutting points to form a fixed and closed loop. The stops, such as bored metal balls, are intermittently mounted and secured, such as by crimping, farther from the loop along the length of the cable manufacture, with each spaced one at its crimped point determining the desired extent of an open mode for an awning that is unraveled with the rotation of the roller tube by the pull on the loop in the operation of the invention. Any one of the stops is readily installed or seated against the body formation of the inner wall forming the tube's slot as a staying element, combining the cable manufacture and roller tube together in a cooperative manner. The slot extends lengthwise substantially fully of the length of the roller tube, sometimes into an end on the tube and sometimes not. However, in either instance, in the operation of this invention, the stop on the cable manufacture is capable of entering the tube's slot through an aperture in the top of the cap and through an aligned slot formed in the wall of the cap or by drilling a larger hole in the slot itself and through which the stop is introduced to the interior hollowness of the roller tube for seating against the tube's inner wall about the slot.

An object of this invention is to provide a novel and unique awning cable manufacture.

Another object of this invention is to eliminate the continual replacement of conventional fabric straps that open and close awnings or other assemblies.

A further object of this invention is to provide an efficacious combination of a cable manufacture to a roller tube of an awning assembly.

A further object of this invention is to eliminate rotting and deterioration of pull articles, as in a pull article for an awning assembly.

Still another object of this invention is to provide a simpler awning opening and closing device with less separate and operable elements to it.

Yet a further object of this invention is to provide a substantial reduction in labor, outlay of cost, and maintenance of the subject matter of the invention by its ease of installation and more lasting life than with materials heretofore utilized in the mobile home and RV industries to open and close an awning apparatus.

Yet another object of this invention is to provide for a cable manufacture readily installable to roller tube assemblies manufactured in different manners by different manufacturers of various kinds of mobile homes and RV's.

These and other objects and advantages of the invention will become more apparent by a full and complete reading of the following description, the appended claims thereto, and the accompanying drawing comprising three (3) sheets of eight (8) FIGURES.

BEST MODE FOR CARRYING OUT THE INVENTION

Figure 2:
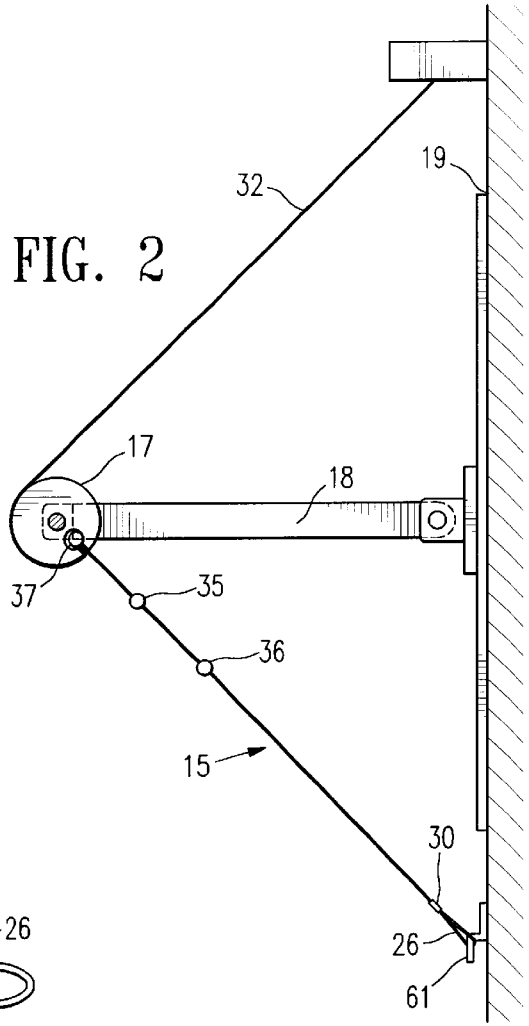
FIG. 2 is view taken on line 2—2 of FIG. 1.
Figure 1:
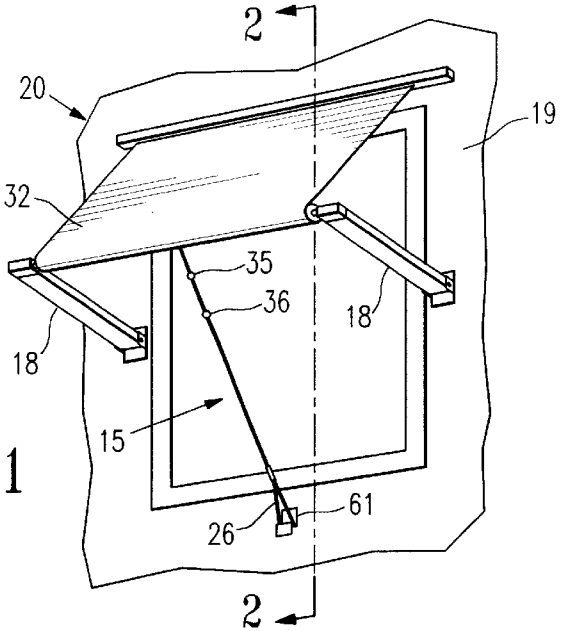
FIG. 1 is a perspective view of an awning assembly in an open mode and mounted to a vehicle and with which the cable manufacture of this invention is combined and installed.
Figure 3:
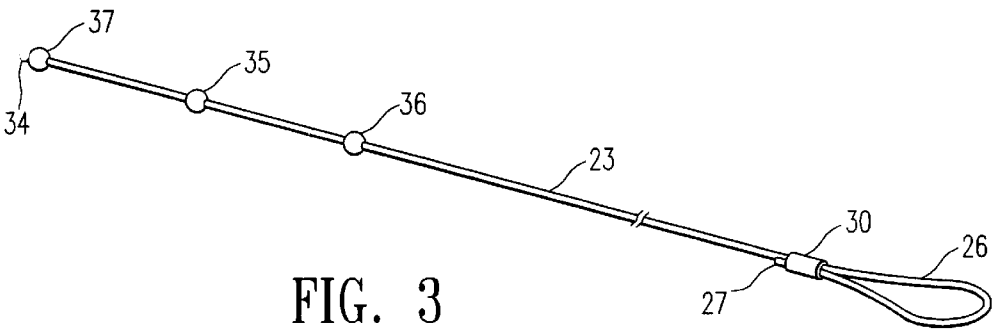
FIG. 3 is a full perspective view of the cable manufacture of this invention.

Referring now to the drawing in which reference characters correspond to like numerals hereinafter in the following description, FIGS. 1, 2, and 3 illustrate a cable manufacture 15 of the invention and its installation to a customary spring-actuated roller tube assembly 17 freely rotatable upon a pair of support arms 18 pivotally mounted in conventional manner to a window frame or side panel 19 of any one of various kinds of mobile and RV's 20. Cable manufacture 15 is formed from a stainless steel cable 23 having a cable loop 26. FIG. 3, formed adjacent to its one end 27 by folding or turning it back upon the cable's length to form a looped portion, loop 26, FIG. 3, in cable 23. At the point at which the turned-back end 27 abuts a point or length along the length of cable 23, a metal sleeve 30 crimps the abutting cable portions together, the metal sleeve 30 being conventionally crimped to these portions of cable 23 thereby generating a fixed closure for loop 26. The remainder of the length of cable 23 continues past crimped sleeve 30 for a suitable finite length to assure of a full open mode for an awning 32 which when unraveled or unwound with roller tube 33 in its assembly 17 from its closed mode abreast the side panel 19 provides a shade from the sun for the interior of a mobile or motor home 20 and a shady spot next to the exteriorly disposed side panel 19. Intermittently along the finite length of cable 25, past crimped sleeve 30 to a free end 34 of cable 23, one or more stops 35, 36, in the form of hard material, such as bored metal balls, are crimped to cable 23. A final stop 37, it being the best mode (without the other stops) of carrying out the invention, is crimped in proximity to the free end 34 and which proximity is at the end 34 or adjacent thereto.

Figure 4:
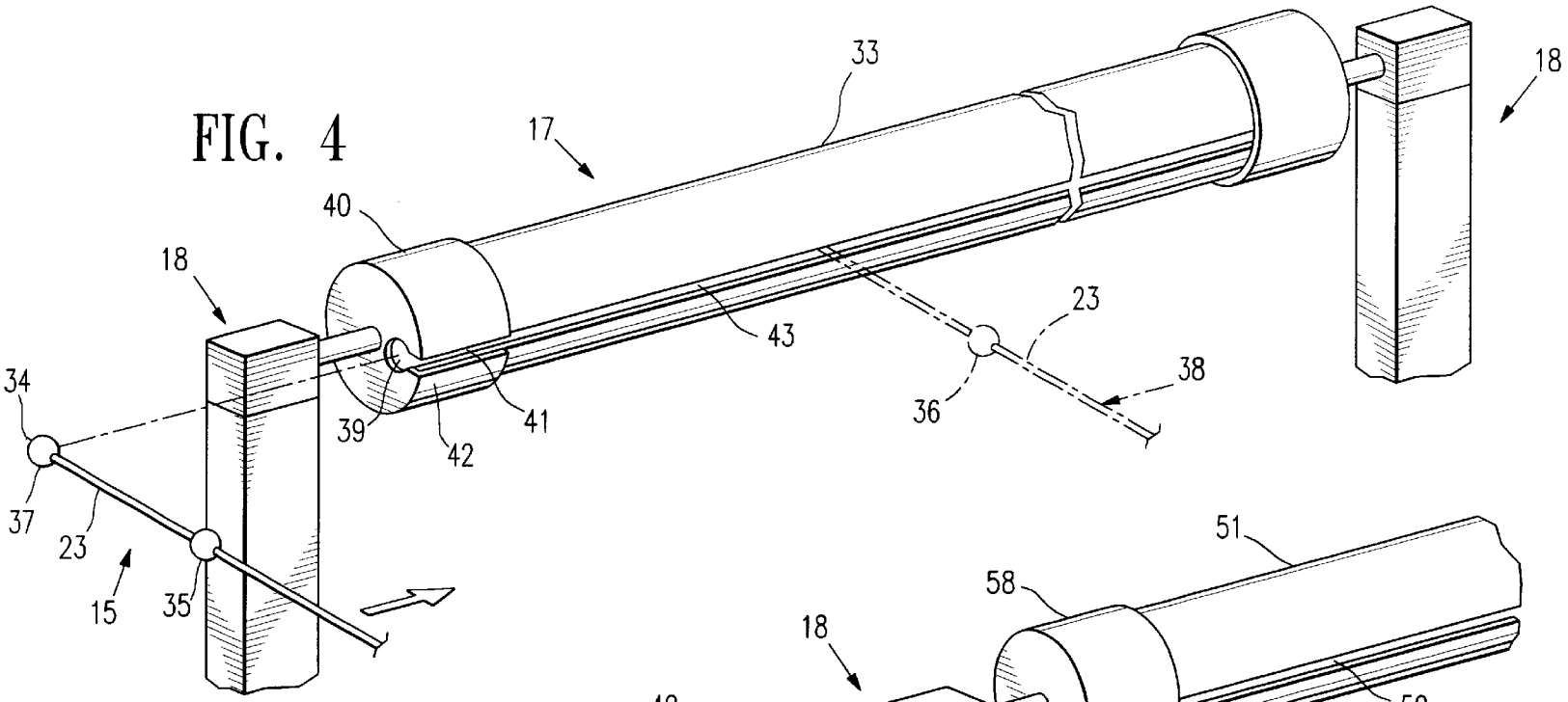
FIG. 4 is a perspective fragmentary view, partly in phantom, of the cable manufacture of this invention preparatory to combining it with and installing it upon one form of a roller tube.

Turning to FIG. 4, cable manufacture 15 is shown in solid lines while its virtual image 38 is shown in phantom as being installed and assembled to roller tube 33. For installation and assembly, any one of the spaced, fixed stops 35, 36, 37 is inserted through an aperture 39 in the top of an end cap 40 on tube 33 while steel cable 23 is slid through a slot 41 in a wall 42 of cap 40, into an aligned lengthwise slot 43 of roller tube 33 and slid to a central region of the tube. Cap 40 may close off slot 43 by turning it on tube 33. Cable manufacture 15, FIGS. 1, 2, does not separate from roller tube 33 directly through slot 43 as the size of each stop 35, 36, 37 is greater than the width of slot 43. Because of such size difference, in the operation of the invention, each stop 35, 36, 37 seats upon or engages, in the interior hollowness of tube 33, the tube's body formation forming slot 43. The body formation can be in a wall structure other than that of tube 3.

Figure 5A:
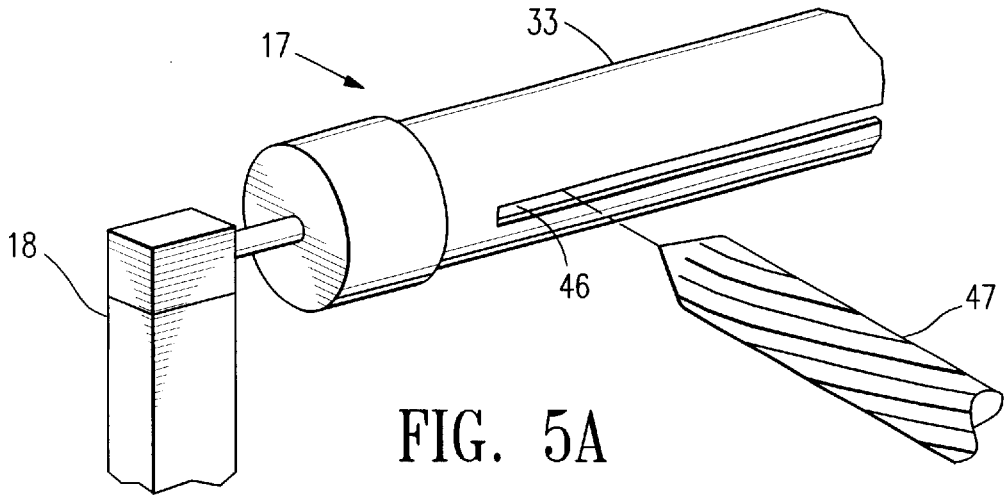
FIG. 5A is a perspective fragmentary view of another or standard form of a roller tube prior to a drilling step which provides an opening in the roller tube for installation of the cable of the manufacture of this invention.
Figure 5B:
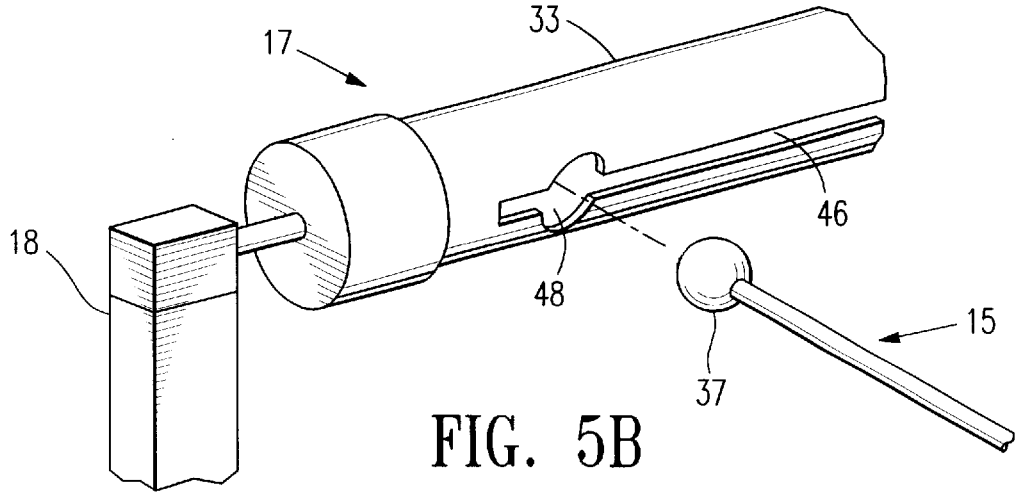
FIG. 5B is a view similar to FIG. 5A, subsequent to the drilling step, and preparatory to installation of the cable of the manufacture of this invention to the roller tube of FIG. 5A.
Figure 5C:
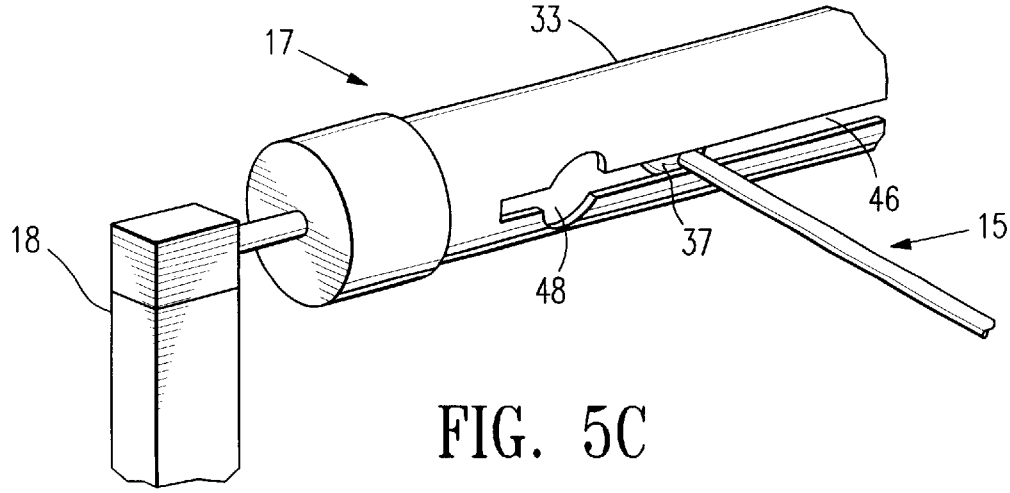
FIG. 5C is a view similar to FIG. 5B, showing an installed cable of the manufacture of this invention to the roller tube of FIGS. 5A and 5B.

FIGS. 5A, 5B, and 5C illustrate the manner of assembly and installation of steel cable 23 to a roller tube 33 having its slot 46 of a length less than the length of tube 33 itself. In this form of roller tube 33, a drill bit 47, FIG. 5A, is operated to form an opening or hole 48, FIG. 5B, across slot 46, large enough for passage of one or all of the stops 35, 36, 37, on cable 23. After formation of such a passage, a particular one of stops 35, 36, 37, is inserted, FIG. 5C, through opening or hole 48, and thereafter, cable 23 can be readily slid towards the central region of roller tube 33 for operation in the opening and closing of an awning apparatus.

Figure 6:
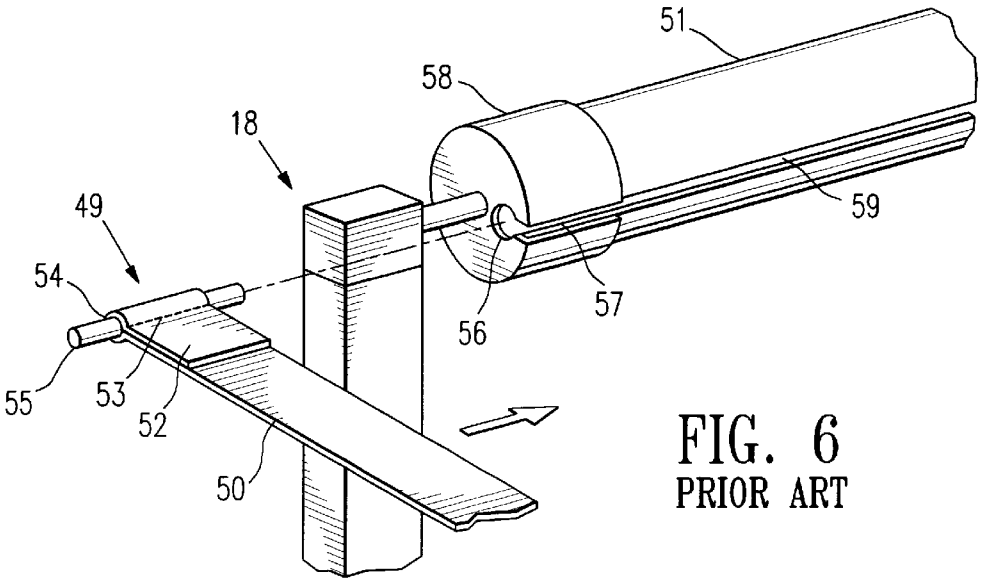
FIG. 6 PRIOR ART
FIG. 6 is a perspective view of a prior art teaching illustrating a customary manner of installing an awning fabric strap assembly to a roller tube.

To understand more fully and to appreciate this advance in the art, FIG. 6 illustrates a conventional connection of a fabric strap assembly 49 to a roller tube 51. The one end 52 of fabric 50 of fabric strap assembly 49 is folded and sewn to the strap itself, as at stitching 53, forming a snug or friction collar 54. A stem 55, usually formed of at least flexible friction-like material, of a length longer than the width of strap assembly 49 is snugly or frictionally disposed, to maintain its disposition, with collar 54. The joined stem 55 and strap 49 are thereafter passed through an aperture 56 and a slot 57 in an end cap 58 of roller tube 51 and which is in alignment with a slot 59 in roller tube 51, and slid to a central region of roller tube 51, so that the assembly of fabric awning strap 49 and stem 55 are disposed in its proper assembled condition and placement for its operation as a staying element of strap 49 within roller tube 51. With a cap not having an aperture and slot in it, the cap is removed from its roller tube for insertion of strap 49 and its stem 55 into the slot of the roller tube.

It should now be apparent that this invention is most suitable and efficacious to roller tubes of awning assemblies utilized in the noted industries.

In the assembly and installation of cable manufacture 15 to roller tube 33, one or more or all of the crimped stops 35, 36, 37, is inserted, FIG. 4, through aperture 39 and slot 42 in end cap 40, and thereafter steel cable 23 is grasped and displaced to a central region of roller tube 33. The particular stop chosen to abut up against the body formation of either slot 43, 46 determines the extant of the open mode for awning 32.

To understand the operation of the invention, it should be or is known that the invention does not change or modify an awning assembly itself as introduction of cable manufacture 15 to it is the same as the introduction of the present day fabric strap assembly is to an awning assembly. To introduce cable manufacture 15 to its roller tube, the canvas or other awning material of roller tube 33 is freely unrolled about support arms 18, by the pulling of cable loop 26. The length of cable loop 26 lies between each circumferential layer of awning material in its rolled up condition on tube 33. To apply cable manufacture 15 to roller tube 33, a manual straight rod (with a hook on its one end) is used to unravel roller tube 33 as it is pulled away from side panel 19, the rod's hook being attached to the (old) fabric strap. Without a fabric strap available for such pulling out, support arms 18 themselves can be manually extended away from side panel 19, which in turn rolls out roller tube 33 and its attached awning material. With roller tube 33 now in full open mode, one or more of stop means 35, 36, 37, is passed into slot(s) 43, 46 as described above, and the roller tube 33 then released from its open mode by the customary spring-biased action of the tube 33 itself to return to its closed mode.

In the application of cable manufacture 15 to an awning assembly, after it has been installed to roller tube 33 and pulled to unravel awning 32 to a desired extant, depending upon which stop 35, 36, 37, is used, cable loop 26 is attached to a support or clete 61, here on side panel 19, to maintain awning 32 in the desired open mode for it. Support arms 18 have pivoted about their connection to side panel 18, and when loop 26 is attached to support or clete 61, the awning assembly remains open as illustrated in FIG. 2. To close the awning assembly from its disposition illustrated in FIG. 2, loop 26 is released from support or clete 61, and the spring-biasing function of tube 33 to collapse the support arm 18 takes over and tube 33 rolls up taking cable manufacture 15 with it along each circumferential layer of awning that rolls up on roller tube 33. The manual straight rod (not shown) is used to control the extant of unraveling and raveling of the awning assembly to achieve its open and closed modes in the customary manner known to do so.

The cable 23 is formed from stainless steel and stops 35, 36, and 37 can be form from aluminum, copper, or other metal material which are generally well known and suitable for application to crimping and to the manufacture of cable manufacture 15, using known techniques and equipment for cutting indeterminate lengths of cable to a suitable length for cable manufacture 15 and for crimping along spaced intervals the stops 35, 36, 37 to the cut finite cable length that forms cable manufacture 15.

Various modifications and changes can be made without varying beyond the spirit and scope of the appended claims following. Stop means 37 need not be securely fixed exactly at the one finite end of cable 23 but may be securely fixed on the length of the cable adjacent to its finite end, in either case being in proximity to end 34. Cable loop 26 is an element efficiently formed in cable 23 itself and it should be understood that its attaching function to a support can apply to another structure and purpose other than to side panel 19, and which is suitable for attaching the cable manufacture 15 to a support point like cleat 61, for completing the operation of the invention in the cable manufacture 15.

INDUSTRIAL APPLICABILITY

The invention is most useful in the mobile home and RV industries for installation of cable manufacture 15 to awning assemblies, however, its utility is useful on hollow tubes and walls in other arts as well.

I claim:

1. A roller-tube-assembly cable manufacture the cable manufacture connectable through a slot in and to its roller tube assembly that is securely mountable to support means for the cable manufacture, comprising a stainless steel cable of a finite length between a first end and a second end of said cable, a closed and fixed loop incorporated in said stainless steel cable at said first end for direct attaching to the support means for the roller tube assembly, and at least one stop means in the form of a bore stainless steel ball crimped in proximity to said second end of said stainless steel cable, whereby said cable manufacture is operable on its roller tube assembly to which it is connected as said crimped stainless steel ball functions as a staying element by its connection through the slot of and to its roller tube assembly as said closed and fixed loop is directly attached to the support means.

2. The roller-tube-assembly cable manufacture of claim 1 including a plurality of bored stainless steel balls crimped intermittently along the finite length of said cable manufacture between its first and second ends.

3. In combination with a roller tube assembly for an awning assembly, the roller tube of said assembly including a slot along its length, a roller-tube-assembly cable manufacture the cable manufacture connected through the slot in said roller tube assembly, said roller tube assembly securely mountable to support means for the cable manufacture, comprising a stainless steel cable of a finite length between a first end and a second end of said cable, a closed and fixed loop incorporated in said stainless steel cable at said first end and direct attachable to the support means, and at least one stop means in the form of a crimped bored stainless steel ball to said cable in proximity to said second end of said stainless steel cable, whereby said cable manufacture is operable on its roller tube assembly to which it is connected as said crimped bored stainless steel ball functions as a staying element by its connection through the slot of and to its roller tube assembly as said closed and fixed loop is directly attached to the support means.

4. The combination of claim 3 including a plurality of bored stainless steel balls crimped intermittently along the finite length of said cable manufacture between its first and second ends.

* * * * *